US005929808A

United States Patent [19]

Hassan et al.

[11] Patent Number: 5,929,808

[45] Date of Patent: Jul. 27, 1999

[54] SYSTEM AND METHOD FOR THE ACQUISITION OF A NON-GEOSYNCHRONOUS SATELLITE SIGNAL

[75] Inventors: Amer A. Hassan; Sami M. Hinedi, both of Kirkland; James R. Miller, Redmond, all of Wash.

[73] Assignee: Teledesic LLC, Kirkland, Wash.

[21] Appl. No.: 08/949,989

[22] Filed: Oct. 14, 1997

[51] Int. Cl.[6] ..... H01Q 3/00

[52] U.S. Cl. ..... 342/368; 342/359; 342/427

[58] Field of Search ..... 342/368, 359, 342/372, 373, 76, 427; 455/13.3

[56] References Cited

U.S. PATENT DOCUMENTS

| | | | |
|---|---|---|---|
| 3,713,163 | 1/1973 | Keller et al. | 343/754 |
| 4,257,048 | 3/1981 | Yokoi et al. | 343/709 |
| 5,025,262 | 6/1991 | Abdelrazik et al. | 343/705 |
| 5,140,333 | 8/1992 | Parker | 342/371 |
| 5,525,990 | 6/1996 | Lewis | 342/39 |
| 5,543,811 | 8/1996 | Chethik | 343/844 |
| 5,559,806 | 9/1996 | Kurby et al. | 370/95.3 |

FOREIGN PATENT DOCUMENTS

| | | |
|---|---|---|
| 0 446 610 A1 | 9/1991 | European Pat. Off. . |
| 0741307A2 | 11/1996 | European Pat. Off. . |
| 4-307381 | 10/1992 | Japan . |
| 5-232205 | 9/1993 | Japan . |
| 8-116208 | 5/1996 | Japan . |
| 2307377A | 5/1997 | United Kingdom . |
| WO 96/08850 | 3/1996 | WIPO . |

*Primary Examiner*—Thomas Tarcza
*Assistant Examiner*—Dao L. Phan
*Attorney, Agent, or Firm*—Seed and Berry LLP

[57] ABSTRACT

An antenna having multiple antenna elements that are selectively activated performs an initial acquisition of a satellite signal by activating only a few of the antenna elements. This results in a broad beam width and increases the likelihood of detecting the signal from the satellite. When the satellite signal is initially detected, the system increases the number of active elements to narrow the beam width. The system incrementally increases the number of active antenna elements until the detected signal from the satellite exceeds a predetermined threshold. At that point, the location of the satellite may be precisely determined and all antenna elements activated to lock onto the satellite signal. If the antenna loses acquisition of the satellite signal, the reverse process may be implemented whereby some elements are selectively deactivated to broaden the beam width of the antenna in an effort to reacquire the satellite signal. When the satellite signal is reacquired, the antenna elements are incrementally reactivated until all antenna elements are active.

37 Claims, 10 Drawing Sheets

SYSTEM AND METHOD FOR THE ACQUISITION OF A NON-GEOSYNCHRONOUS SATELLITE SIGNAL

TECHNICAL FIELD

The present invention is directed generally to satellite communication, and, more particularly, to a system and method for acquiring a non-geosynchronous satellite signal.

BACKGROUND OF THE INVENTION

Satellites are used for a wide variety of communications ranging from telephone communications to high speed data communications. A variety of satellites in various orbits are used to provide the different forms of communication. For example, it is common to use communication satellites in geosynchronous orbits. Such geostationary orbits require the insertion of satellites at a location approximately 22,300 miles from earth. Geosynchronous satellites have a circular orbit that lies in the plane of the earth's equator and turn about a polar axis of the earth in the same direction and with the same period as the rotation of the earth such that the satellite is in a fixed position relative to the surface of the earth. Satellites in a geosynchronous orbit have a period of revolution equal to the period of rotation of the earth about its axis.

An earth-based station is used to communicate with a geosynchronous satellite. The earth-based station may have receive-only capability, such as a satellite television receiver, or may include transmission capability to provide a data uplink to a satellite. In either event, the earth-based station must include an antenna that is aimed at the desired satellite. The process of aiming the antenna requires some knowledge of the location of the desired satellite as well as the ability to aim the antenna in the desired direction. This process can be quite time consuming and can require significant technical expertise.

While the process of aiming the antenna can be time consuming, it is typically considered part of a normal installation of an earth-based station at a fixed location and aimed at a geosynchronous satellite. Once the fixed location earth-based station has been pointed towards a particular geosynchronous satellite, it is possible to redirect the antenna on the earth-based station to communicate with other geosynchronous satellites, which have fixed and known locations with respect to each other. For example, a satellite television receiver need only be aligned to detect a first satellite in geosynchronous orbit during an initial installation. Thereafter, the satellite antenna may be moved a known amount to permit reception of broadcast signals from other satellites in geosynchronous orbits and then returned to the known position aiming at the first satellite to receive signals from the first satellite.

The antenna aiming problem is more complex, however, when an earth-based station attempts to communicate with a satellite in a non-geosynchronous orbit, such as a low-Earth orbit (LEO) or a middle-Earth orbit (MEO). Because of their orbits, LEO and MEO satellites will move in the sky when viewed from a fixed ground location and will typically only be in view of a particular earth-based station for a limited period of time. Each time a LEO or MEO satellite comes into range of can earth-based station, the earth-based station must therefore re-aim the antenna to acquire the satellite. Having to continually repoint the antenna to acquire a LEO or MEO satellite that comes into range can be a very time-consuming process that ultimately impacts the total time that the earth-based station may communicate with the satellite. Therefore, it can be appreciated that there is a significant need for a system and method for simplifying and speeding the acquisition of a satellite signal. The present invention provides this and other advantages, as will become apparent from the following figures and accompanying detailed description.

SUMMARY OF THE INVENTION

The present invention is embodied in the system and method for the acquisition of a satellite signal transmitted from a satellite in non-geosynchronous earth orbit. The system comprises an antenna having an alterable antenna beam width and a radio receiver circuit configured to detect the satellite signal. A controller coupled to the antenna selectively alters the antenna beam width. The controller initially sets the antenna for operation with a broad beam width to enable fast detection of the satellite signal. Upon detection of the satellite signal by the radio receiver circuit, the controller incrementally decreases the antenna beam width.

The system may further include a power detection circuit within the radio receiver circuit to detect the satellite signal and to generate a power signal indicative of the signal strength of the satellite signal. The controller may use the power signal to incrementally decrease the antenna beam width if the power signal indicates that the satellite signal strength is increasing. The antenna may be optionally configured for operation in the S-Band or the Ka-Band. In an exemplary embodiment, the satellite signal is a satellite beacon signal and the radio receiver circuit is configured for reception of the satellite beacon signal.

In one embodiment, the antenna is a phased array antenna having a plurality of antenna elements that are selectively activated to incrementally decrease the antenna beam width. In one embodiment, the antenna is a two-dimensional phased array antenna with the first plurality of antenna elements arranged in a first dimension and a second plurality of antenna elements arranged in a second dimension substantially orthogonal to the first dimension. Alternatively, the antenna may be a one-dimensional phased array antenna with a plurality of antenna elements arranged in a first dimension. The antenna elements may be selectively activated to incrementally decrease the antenna beam width. The system may further include a rotating member coupled to the one-dimensional phased array antenna to permit rotational movement of the one-dimensional phased array antenna in a second dimension different from the first dimension.

DETAILED DESCRIPTION OF THE INVENTION

Figure 1:
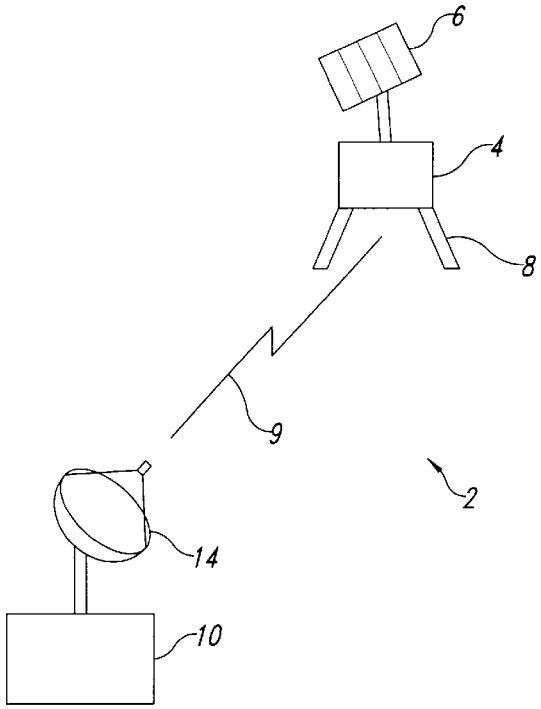
FIG. 1 is a pictorial diagram illustrating an earth-based station and a non-geosynchronous satellite in a satellite communication system.

A portion of a low-Earth orbit (LEO) or middle-Earth orbit (MEO) satellite communication system 2 is illustrated in the schematic diagram of FIG. 1. The satellite is a portion of a larger constellation, such as the constellation described in U.S. Pat. No. 5,408,237, assigned to the assignee of the present application and herein incorporated by reference. The satellite communication system 2 includes a satellite 4 having a power source 6, such as solar panels, and internal circuitry (not shown). The internal circuitry includes a transmitter and receiver. The satellite 4 also includes a satellite antenna 8 to transmit and receive radio frequency (RF) signals 9.

The satellite communication system 2 also includes an earth-based station 10 designed to communicate with the satellite 4. The earth-based station 10 includes internal electronic circuitry (not shown), such as a transmitter and/or receiver. The earth-based station 10 also includes a directional antenna 14. The directional antenna 14 must be properly aligned with the satellite antenna 8 to effectively communicate with the satellite 4. Because a LEO or MEO satellite will be visible to the earth-based station for a limited period of time, it is desirable to minimize the alignment period in order to maximize the communication period with the satellite.

To assist in the acquisition of the RF signals from the satellite 4, the satellite broadcasts a beacon signal that is used by the earth-based station 10 to locate and identify a particular satellite. As is known by those of ordinary skill in the art, once the satellite is located, the transfer of data between the satellite 4 and the earth-based station 10 must be synchronized. Data synchronization procedures between a satellite and an earth-based station are well known and need not be described herein.

The initial alignment of the directional antenna 14 with the satellite antenna 8 to acquire the signal from the satellite 4 can be quite time consuming. The alignment is exacerbated by the fact that the directional antenna 14 is preferably a high gain antenna with a narrow beam width. A narrow beam width is desirable so that transmission power is confined to a small volume and not wasted by providing broad beam coverage. The signal to noise ratio is also improved by concentrating the RF transmission to a small volume.

Figure 2:
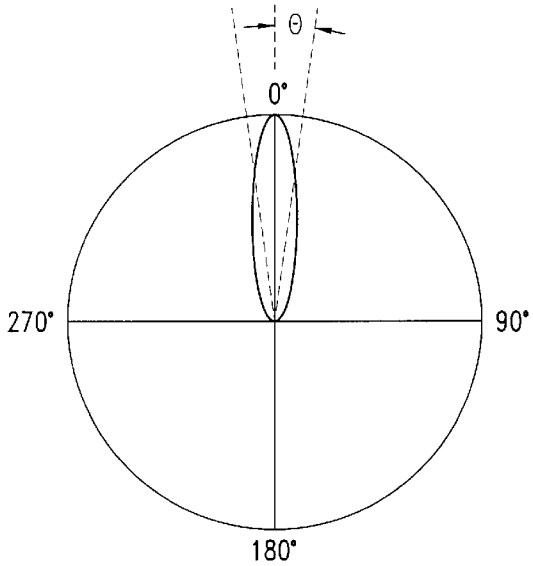
Fig. 2 (PRIOR ART)
FIG. 2 is a chart illustrating the antenna gain and beam pattern of a conventional dish antenna, such as may be used by the earth-based station of FIG. 1.

FIG. 2 is a polar plot illustrating the relative gain and beam pattern of a conventional dish antenna, and suggests the difficulty in using the dish antenna as the directional antenna 14. Conventional dish antennas have a beam width of approximately 2½°. The term "beam width" is used to define the angle θ formed by the beam center of the antenna and the point at which the gain of the antenna is one-half of the maximum gain. As illustrated in FIG. 2, the gain of the dish antenna 14 decreases rapidly if the satellite antenna 8 is not precisely aligned with the beam center of the dish antenna 14. A conventional dish antenna must therefore be precisely aligned with the satellite antenna 8 (see FIG. 1) to within the 2½° beam width in order to acquire the satellite beacon signal.

Performing a rapid alignment is very difficult when using a conventional dish antenna having the polar plot depicted in FIG. 2. Antenna direction is usually specified in terms of an elevation and an azimuth. During an initial acquisition of the satellite signal, it is necessary to adjust both the elevation and azimuth of the directional antenna 14 in an effort to detect the signal from the satellite 4. In effect, the earth-based station 10 must perform a three-dimensional search of the entire sky, or at least a portion thereof where the satellite to be acquired is known to be present, to acquire the signal from the satellite 4. When using an antenna with a narrow beam width, the acquisition procedure is particularly time consuming. The use of a conventional dish antenna is therefore unacceptable for an earth-based station that is to communicate with a LEO or MEO satellite.

The present invention is directed to a technique for quickly locating and acquiring the beacon signal, or other broadcast signal, from the satellite 4. The present invention dynamically alters the antenna so that the antenna initially has a broad beam width to more quickly locate the satellite 4. When the satellite 4 has been located, the present invention dynamically reduces the beam width to "lock" onto the satellite 4.

Figure 3:
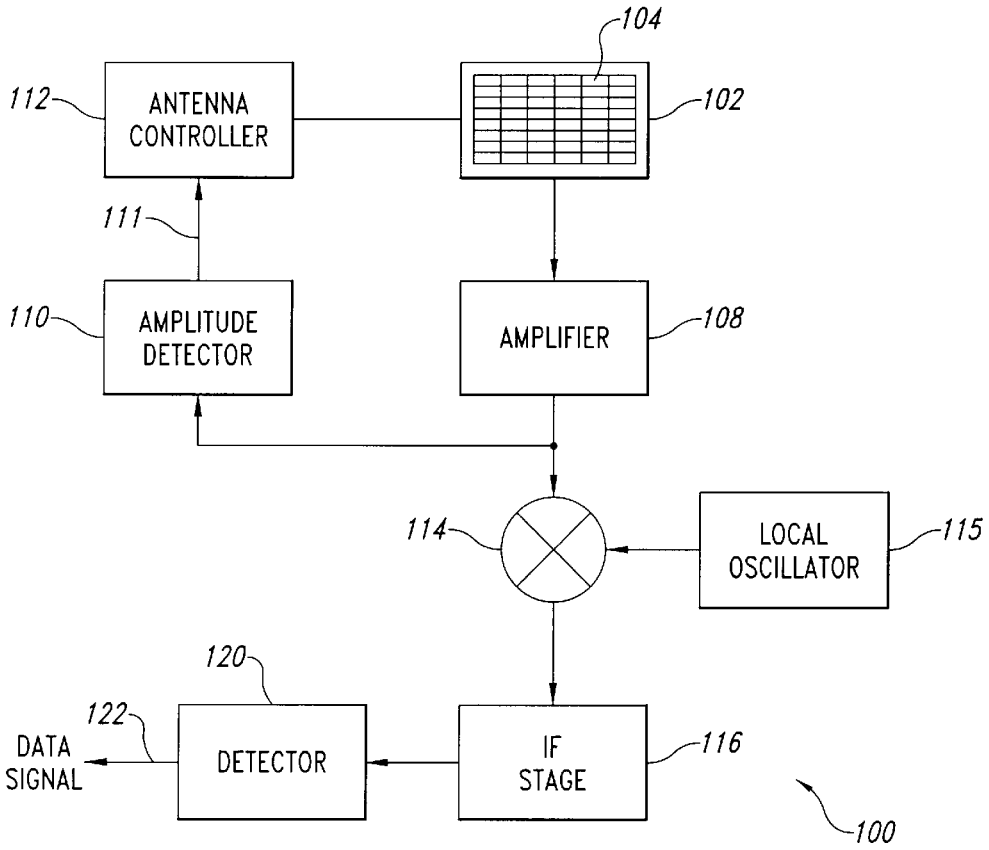
FIG. 3 is a functional block diagram of the system of the present invention.

The present invention is embodied in a system 100 illustrated in the functional block diagram of FIG. 3. Although an earth-based station may include a transmitter, the transmitter is unnecessary for detecting and acquiring the beacon signal from the satellite 4. Therefore, for the sake of simplicity, FIG. 3 illustrates only a receiver portion of the earth-based station. The system 100 includes an antenna 102, such as a phased array antenna, to detect RF signals from the satellite 4. For the sake of clarity, the antenna 102 will be described as a phased array antenna. However, as will be described in detail below, alternative antenna designs can be used with the system 100. Accordingly, the present invention is not limited by the specific antenna design.

Conventional phased array antennas are known for their high gain and narrow beam width as well as the ability to be electronically steered. That is, the azimuth and elevation of the phased array antenna are electronically controlled to aim the antenna without physically moving the antenna. The conventional phased array antenna includes a plurality of antenna elements, all of which are active and phase controlled to electronically steer the phased array antenna. A conventional phased array antenna with very few elements has relatively lower gain and a broader beam width.

The phased array antenna 102 of the system 100 contains a plurality of antenna elements 104, which are electronically steerable and can be selectively activated and deactivated to alter the receiving and transmitting beam width of the antenna. The antenna elements 104 are activated and deactivated by applying and removing electrical power to the individual antenna elements.

Figure 4:
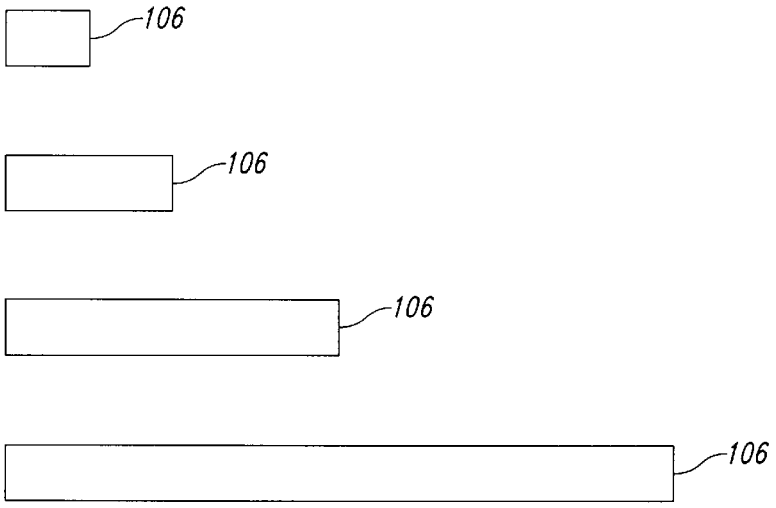
FIG. 4 illustrates delay lines used to implement a phased array antenna embodiment of the system of FIG. 3.

For operation in the S-band, the phased array antenna 102 has hundreds of antenna elements 104. For operation in the Ka-band, there are thousands of antenna elements 104 in the phased array antenna 102. In a typical implementation, each antenna element 104 is coupled to multiple delay lines 106, illustrated in FIG. 4, that provide selectable phase delay for each antenna element. FIG. 4 illustrates the use of a 4-bit phase delay circuit. Those of ordinary skill in the art can appreciate that additional delay lines could be used to form a phase delay circuit using 5-bits, 6-bits or other number of data. Through the appropriate selection of phase delays generated by a selected one of the delay lines 106 for each of the antenna elements 104, RF signals detected by each of the antenna elements are added to provide selective reinforcement and cancellation of the RF signals and thus electronically aim or steer the phased array antenna 102. Other techniques, such as digital multiplication may also be used to control the phase of the antenna element 104 and thus electronically steer the phased array antenna 102.

Returning again to FIG. 3, the output of the phased array antenna 102 is coupled to an amplifier 108, which amplifies the received RF signals. The output of the amplifier 108 is coupled an amplitude detector system 110 to determine the strength of the detected signal from the satellite 4 (see FIG. 1). As will be discussed in detail below, the initial location of the satellite 4 can be detected merely by measuring the amplitude of the detected signal without regard to the specific data transmitted as part of the beacon signal. The amplitude detector system 110 generates a detection signal 111, which is indicative of the amplitude or signal strength of the detected signal from the satellite 4. An antenna controller 112 uses the detection signal 111 to control activation of the antenna elements 104 and to aim the phased array antenna 102 in the appropriate direction.

The output of the amplifier 108 is also coupled to an input of a demodulator/mixer 114. Also coupled to the demodulator/mixer 114 is a local oscillator 115. The signal from the local oscillator 115 is mixed with the signal from the amplifier 108 to produce an intermediate frequency (IF) signal. The system 100 also includes an IF stage 116, with circuitry such as an IF filter (not shown) and an IF amplifier to process the IF signal. The components may be combined into a single electronic circuit. The output of the IF stage 116 is coupled to a detector 120. The specific form of the detector 120 depends on the form of modulation used by the satellite 4. The output of the detector 120 is a demodulated data signal 122.

The operation of the system 100 may now be described in greater detail. In the embodiment illustrated in FIG. 3, the antenna elements 104 are disposed in a first dimension and in an orthogonal second dimension thus forming a two-dimensional array. The antenna controller 112 selectively activates and deactivates individual ones of the antenna elements 104 to alter the beam width of the phased array antenna 102. In addition, the antenna controller 112 controls the phase delay from each of the antenna elements 104 to electronically steer the phased array antenna 102. The operation of the antenna controller 112 to control the phase delay of the antenna elements 104 and thus the direction of the phased array antenna 102, is known in the art and need not be described in greater detail herein. The operation of the antenna controller 112 to selectively activate and deactivate the antenna elements will be described in greater detail.

The system 100 selectively activates and deactivates antenna elements 104 in order to alter the beam width of the phased array antenna 102. As a result of the selective activation and deactivation, the gain of the phased array antenna 102 is also altered. The system 100 initially activates only a few of the antenna elements 104 of the phased array antenna 102. By activating only a few of the antenna elements 104, the beam width of the phased array antenna 102 is increased. It should be noted that antenna elements 104 that are selectively deactivated have no effect on the overall performance of the phased array antenna 102. That is, the deactivated antenna elements 104 do not act as passive radiators and thus do not alter the beam width or the gain of the phased array antenna 102. Therefore, the performance of the phased array antenna 102 is governed solely by the selectively activated antenna elements 104.

In an exemplary embodiment, the initial beam width of the phased array antenna 102 is 30°. The broad beam width advantageously allows the phased array antenna 102 to search a larger portion of the sky in an effort to acquire the beacon signal from the satellite 4 (see FIG. 1). When the beacon signal from the satellite 4 has been detected, the antenna controller 112 activates additional antenna elements 104 to narrow the beam width and increase the gain of the phased array antenna 102 to better locate the satellite and acquire the signal. When the location of the satellite 4 has been accurately determined, the antenna controller 112 activates all of the antenna elements 104 to provide the narrowest beam width and highest gain for the phased array antenna 102.

Figure 5A:
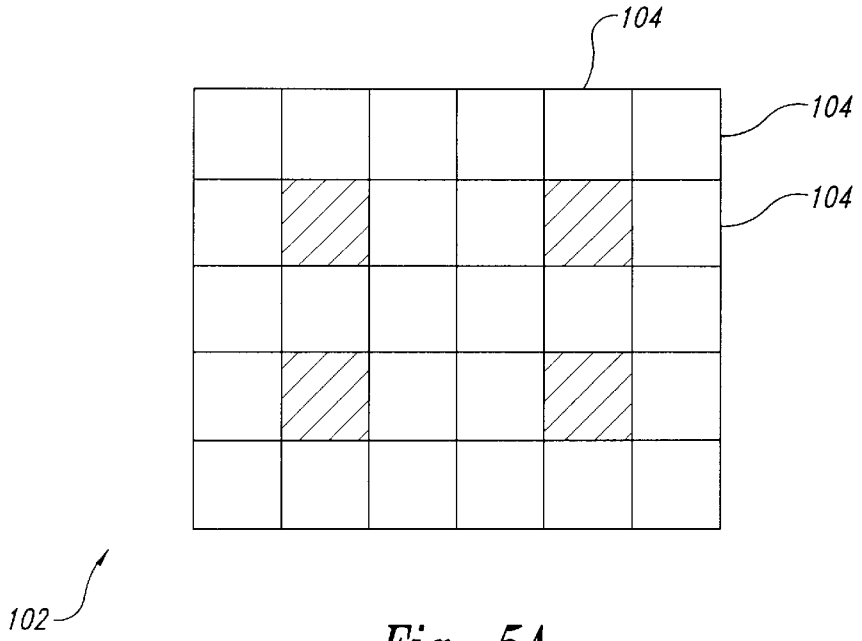
FIG. 5A illustrates the selective activation of a portion of the antenna elements by the system of FIG. 3.
Figure 5B:
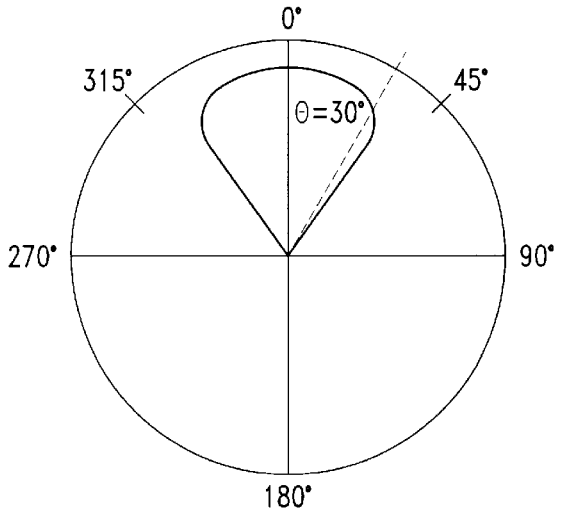
FIG. 5B illustrates the beam pattern and gain of the antenna with the activated elements illustrated in FIG. 5A.
Figure 5C:
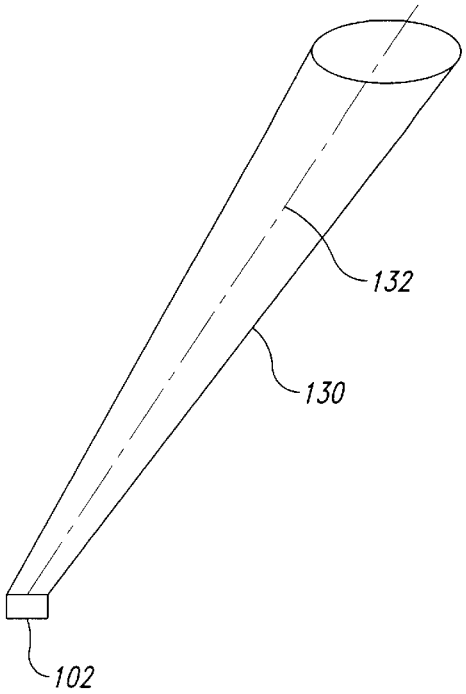
FIG. 5C illustrates the three-dimensional beam pattern formed by the activated antenna of FIG. 5A.

During an initial acquisition of the beacon signal from the satellite 4, the antenna controller 112 activates only a few antenna elements 104, such as illustrated in FIG. 5A where active elements are indicated by a cross-hatch pattern. FIG. 5B illustrates the beam pattern and gain of the phased array antenna 102 with the active elements illustrated in FIG. 5A. Although FIG. 5B only illustrates the beam pattern in the azimuth direction, the beam pattern is substantially symmetrical thus forming an electronically steerable upward projecting pattern 130 with a beam center 132, as illustrated in FIG. 5C. With all antenna elements 104 activated in the phased array 102, the antenna beam pattern is similar to the antenna beam pattern of a conventional dish antenna, which is illustrated n FIG. 2. As can be readily seen from FIG. 5B, the gain of the phased array antenna of FIG. 5A is, however, significantly decreased when compared with the gain of the directional antenna 14 illustrated in FIG. 2. However, the advantage of the phased array antenna 102 illustrated in FIG. 5A is that the broad beam width permits the detection of the beacon signal from the satellite 4 even when the satellite is not directly aligned with the beam center of the phased array antenna.

Figure 5D:
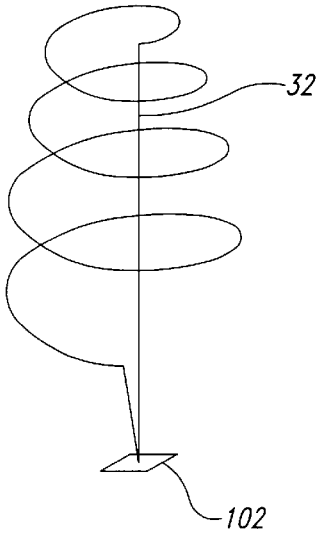
FIG. 5D illustrates a three-dimensional search pattern used by the antenna of the system of FIG. 3.

The antenna controller 112 electronically steers the active antenna elements 104 of the phased array antenna 102 in a conventional fashion. However, because of the broad beam width of the phased array antenna 102, the system 100 can scan a much broader portion of the sky than is possible with the conventional dish antenna whose narrow beam width is illustrated in FIG. 2. In an exemplary embodiment, the antenna controller 112 electronically steers the active antenna elements in a descending spiral pattern beginning at a zenith location directly above the phased array antenna 102. That is, the elevation of the phased array antenna 102 is set to a zenith location and the azimuth is varied to sweep in a 360° search pattern is the elevation is slowly decreased from the zenith. This is illustrated in FIG. 5D where the beam center 132 is initially directed to the zenith and electronically steered in a descending spiral pattern until the beacon signal from the satellite 4 is detected. A spiral search pattern maximizes the possibility of detecting the beacon signal from the satellite 4. However, other search patterns may also be used, such as a scan of the azimuth beginning at a zenith point (i.e., maximum elevation), and decreasing elevational angle as the azimuth is scanned back and forth. Furthermore, a search of the entire sky is not necessary if the general location of the satellite 4 is already known. Under these circumstances, the phased array antenna 102 may be electronically steered to the approximate location of the satellite and the search restricted to that portion of the sky.

As previously discussed, the beacon signal from the satellite 4 may be modulated to contain information about the identity of the satellite transmitting the beacon signal. The beacon signal is used to locate the satellite, however, even before the strength of the beacon signal is sufficient to allow the earth-based station to demodulate and decode the information contained in the signal. When the beacon signal from the satellite 4 is initially detected by the phased array antenna 102 illustrated in FIG. 5A, the amplifier 108 amplifies the detected signal. When the signal amplitude from the output of the amplifier 108 rises above a predetermined threshold, the amplitude detector 110 generates the detection signal 111, which is coupled to the antenna controller 112. The magnitude of the detection signal 111 corresponds to the strength of the signal detected by the phased array antenna 102. That is, the detection signal 111 indicates whether the beacon signal from the satellite 4 has been detected somewhere within the beam of the phased array antenna 102. The antenna controller 112 therefore uses the detection signal 111 to assist in electronically steering the phased array antenna 102, as illustrated in FIG. 5A, to locate the approximate position of the satellite 4 (see FIG. 1). The antenna and detection system is designed so that the beacon signal from the satellite 4 can be detected by the phased array antenna 102 illustrated in FIG. 5A, even if the signal level is not yet sufficient to demodulate the signal.

Figure 6A:
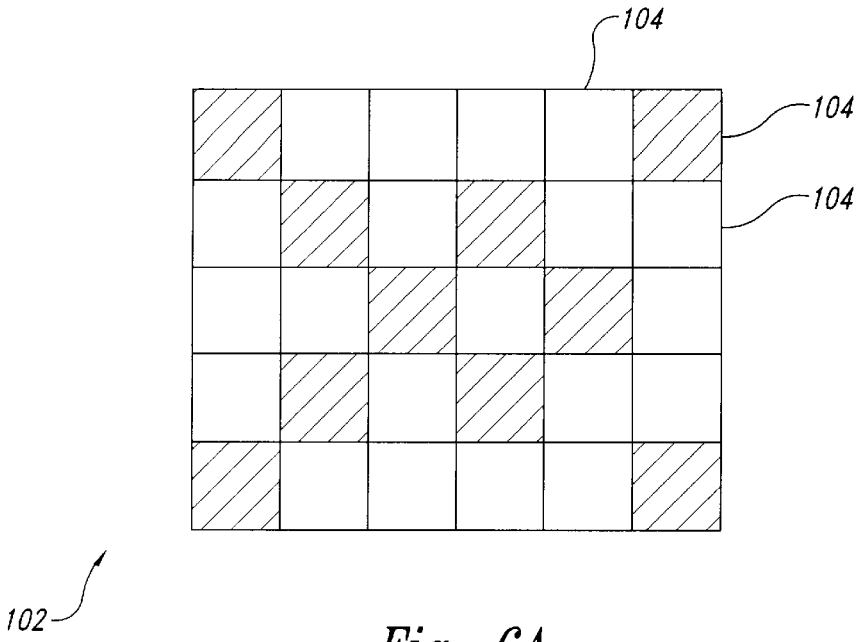
FIG. 6A illustrates the selective activation of additional antenna elements by the system of FIG. 3.
Figure 6B:
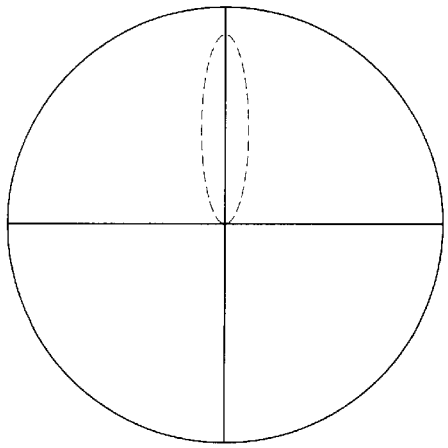
FIG. 6B illustrates the beam pattern and gain of the antenna with the activated elements illustrated in FIG. 6A.

The precise location of the satellite 4 cannot be determined with the broad beam width of the phased array antenna 102 illustrated in FIG. 5A. Upon initial receipt of the detection signal 111, the antenna controller 112 therefore activates additional antenna elements 104, as illustrated in FIG. 6A, where the active antenna elements 104 are indicated by the cross-hatch pattern. With additional active antenna elements 104, the system 100 begins a second, more narrow search to locate the precise position of the satellite compared with the initial position determined by the antenna of FIG. 5A. FIG. 6B illustrates the beam pattern and gain of the phased array antenna 102 with the additional active elements illustrated in FIG. 6A. As can be readily determined from FIG. 6B, the phased array antenna 102 of FIG. 6A has decreased beam width and increased gain when compared with the phased array antenna of FIGS. 5A and 5B and thus can more precisely locate the position of the satellite 4 than is possible with the phased array antenna of FIGS. 5A and 5B.

Figure 7A:
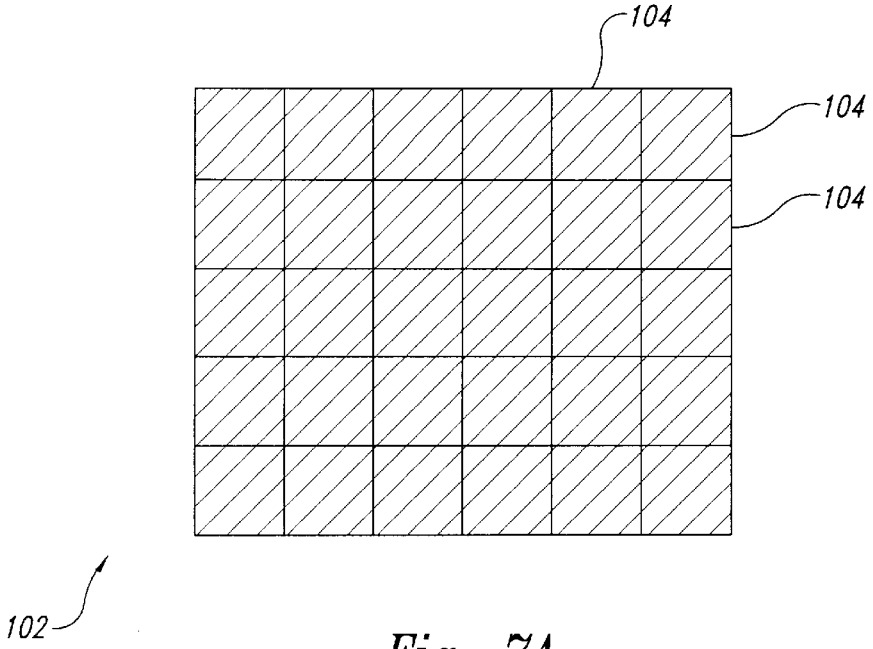
FIG. 7A illustrates the selective activation of all antenna elements by the system of FIG. 3.
Figure 7B:
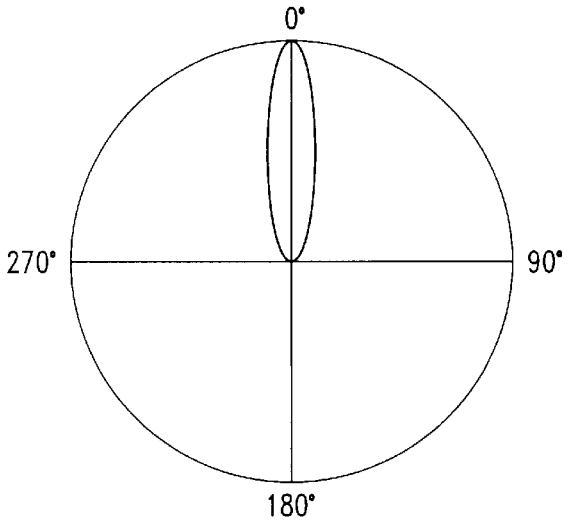
FIG. 7B illustrates the beam pattern and gain of the antenna with activated elements illustrated in FIG. 7A.

When the location of the satellite 4 is more precisely determined by the use of additional active elements in the phased array antenna 102, the antenna controller 112 activates all of the antenna elements 104 of the phased array antenna, as illustrated in FIG. 7A, where the active antenna elements are indicated by the cross-hatch pattern. FIG. 7B illustrates the beam pattern and gain of the phased array antenna of FIG. 7A. As can be seen from FIG. 7B, the characteristics of the phased array antenna 102 illustrated in FIG. 7A are similar to the characteristics of a conventional dish antenna in that it provides a narrow beam width with high gain. In an actual embodiment of the phased array antenna 12, the gain of the phased array antenna 102 with a few antenna elements 104 activated, as illustrated in FIG. 5A, has approximately 12 dB less gain than the same antenna with all antenna elements activated, as illustrated in FIG. 7B.

To summarize, the system 100 initially focuses the phased array antenna 102 in the general direction from which the satellite signal is detected, and then activates more and more antenna elements as the location of the satellite is more precisely determined until such time as all antenna elements are active and the phased array antenna is focused precisely on the satellite 4. The progressive activation sequence of FIGS. 5A, 6A, and 7A illustrate a technique for quickly locating the beacon signal from the satellite 4 (see FIG. 1) and "homing" in on the location of the satellite. It should be noted that the activation of antenna elements 104 can be performed in more than the three stage process illustrated in FIGS. 5A, 6A, and 7A. In addition, the antenna controller 112 can activate different antenna elements 104 from those illustrated in the exemplary embodiments of FIGS. 5A, 6A, and 7A. Thus, the system 100 of the present invention uses an electronically controlled antenna which actively alters the beam width of the antenna to determine the location of the satellite 4. The system 100 continues to decrease the antenna beam width as the location of the satellite becomes more precisely determined. Finally, the beam width of the antenna is narrowed significantly when the precise location of the satellite 4 has been determined.

As previously discussed, the initial acquisition of the satellite beacon signal does not require demodulation of the beacon signal itself. Rather, the amplitude detector 110 simply determines the strength of the beacon signal. The initial acquisition process, using only the received signal strength, may be considered a "coarse synchronization." When the strength of the beacon signal is sufficiently high, the remaining portions of the system, including the demodulator/mixer 114, IF stage 116, and detector 120 generate the data signal 122 containing the information that is encoded in the beacon.

The system 100 is particularly useful with a mobile earth-based station, which must quickly acquire the beacon signal from the satellite 4. The system 100 enables the detection of the beacon signal from the satellite 4 in a matter of seconds rather than several minutes as would typically be required by the conventional directional antenna 14 (see FIG. 1). The system 100 may also be used in non-terrestrial applications, such as when installed in an aircraft. With the aircraft flying in a straight line, acquisition of the beacon signal from the satellite 4 can be accomplished in a short period of time. If the aircraft turns, or changes position due to, for example, turbulence, the system 100 can rapidly reacquire the beacon signal from the satellite 4.

The process for reacquisition of the beacon signal from the satellite 4 is essentially the reverse process described above. Assuming that the system 100 has already acquired the beacon signal from the satellite 4 and that all antenna elements 104 are active, the phased array antenna 102 will have a beam width and gain such as illustrated in FIG. 7B. If the system 100 loses acquisition of the beacon signal, the antenna controller 112 can selectively deactivate some antenna elements 104 to progressively broaden the beam width of the phased array antenna 102. It is not necessary for the antenna controller 112 to deactivate most antenna elements, such as illustrated in FIG. 5A, since the general location of the satellite 4 is already known. Instead, the antenna controller 112 can activate antenna elements 104 in a manner illustrated in FIG. 6A to slightly broaden the beam width of the phased array antenna 102, as illustrated in FIG. 6B. If the satellite beacon signal is still not reacquired, the antenna controller 104 may deactivate additional antenna elements, thus incrementally increasing the beam width of the antenna until the beacon signal of the satellite 4 is required. When the beacon signal has been reacquired, the antenna controller 112 operates in the manner described above to incrementally increase the number of active elements in the phased array antenna to narrow the beam width of the phased array antenna 102.

Figure 8A:
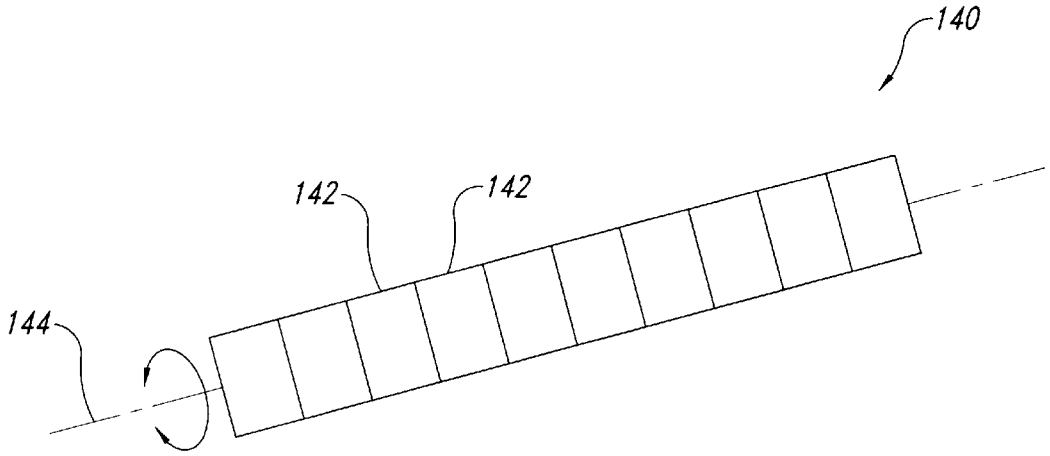
FIG. 8A is a perspective view of an alternative embodiment of the antenna of the system of FIG. 3.
Figure 8B:
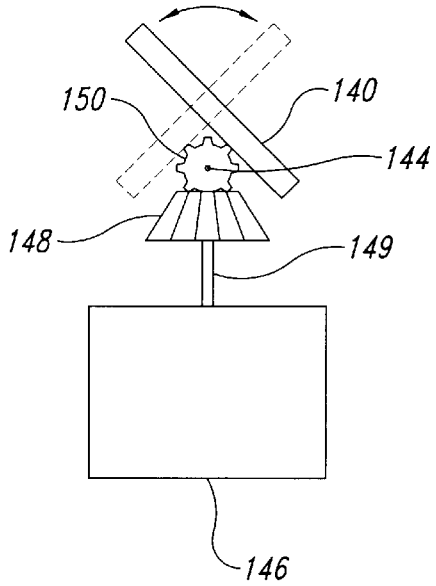
FIG. 8B is a side elevational view of the antenna of FIG. 8A.

FIG. 3 illustrates a two-dimensional embodiment of the phased array antenna 102. However, alternative embodiments of the phased array antenna 102 are possible. For example, FIGS. 8A and 8B illustrates a one-dimensional phased array antenna 140 having a plurality of antenna elements 142 disposed in a single dimension. In the exemplary embodiment illustrated in FIG. 8A, the azimuth direction of the phased array antenna 140 is electronically steered by the antenna controller 112 (see FIG. 3) in the manner described above. As illustrated in FIG. 8B, the phased array antenna 140 is pivotally mounted so as to permit movement of the phased array antenna about an axis of rotation 144 to control the elevation of the phased array antenna. A motor 146 positioned in proximity with the phased array antenna 140 controls the elevation of the phased array antenna. A motor gear 148 coupled to a shaft 149 of the motor 146 is in mechanical engagement with a rotational gear 150, which is coupled to the phased array antenna 140. The motor gear 148 rotates along with the motor shaft 149 and causes rotation of the rotational gear 150 which, in turn, causes rotational movement of the phased array antenna 140 about the axis of rotation 144.

In an exemplary embodiment, the motor 146 is part of a conventional closed-loop servo system in which the phased array antenna 140 is rotated about the axis of rotation 144 to control the elevation of the phased array antenna 140 while the antenna controller 112 controls the azimuth direction of the phased array antenna in the manner previously described. The closed-loop servo system is designed to adjust the elevation of the phased array antenna 140 to maximize the signal level of the detection signal 111 from the amplitude detector 110.

The system 100 described above is capable of the rapid detection and acquisition of the beacon signal from the satellite 4 (see FIG. 1). If the satellite 4 is geosynchronous, the phased array antennas 102 and 140 will remain in a fixed position once the beacon signal has been detected. However, if the satellite 4 is not geosynchronous, or the system 100 is installed in a mobile setting (e.g., an aircraft), the antenna controller 112 is capable of electronically steering the phased array antennas 102 and 140 so as to track the satellite. Tracking ability is particularly important if the satellite 4 is in a low-Earth orbit because a LEO satellite moves quickly across the sky The use of the antenna controller 112 to track a moving satellite from a fixed or mobile location is well-known in the art, and need not be described in detail herein.

Figure 9:
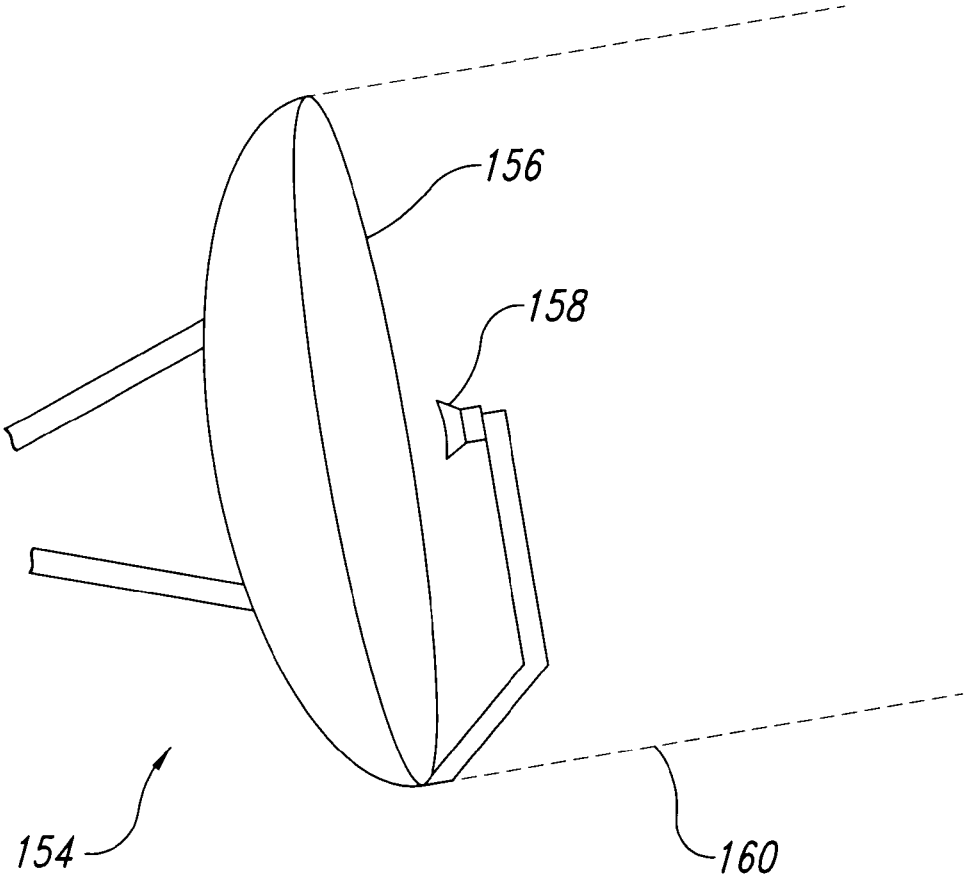
FIG. 9 is a perspective view of another alternative embodiment of the antenna of the system of FIG. 3.

The principles of the present invention are also applicable to other forms of antennas besides phased array antennas. For example, FIG. 9 illustrates a dish antenna 154 that includes a parabolic reflector- 156 and a horn antenna 158. In normal operation, the horn antenna 158 is located substantially at the focal point of the parabolic reflector to collect RF signals reflected from the parabolic reflector 156. With the horn antenna 158 located at the focal point, the dish antenna 154 has a beam width 160 illustrated by the dashed lines in FIG. 9. However, it is possible to physically move the horn antenna 158 to alter the beam width. Alternatively, it is possible to have multiple feed points controlled by multiple horn antennas (not shown). It is known that the beam width is inversely proportional to the reflector area. With one or more horn antennas 158 being activated, the effective reflector area can be varied, thus altering the beam width of the dish antenna 154.

Figure 10A:
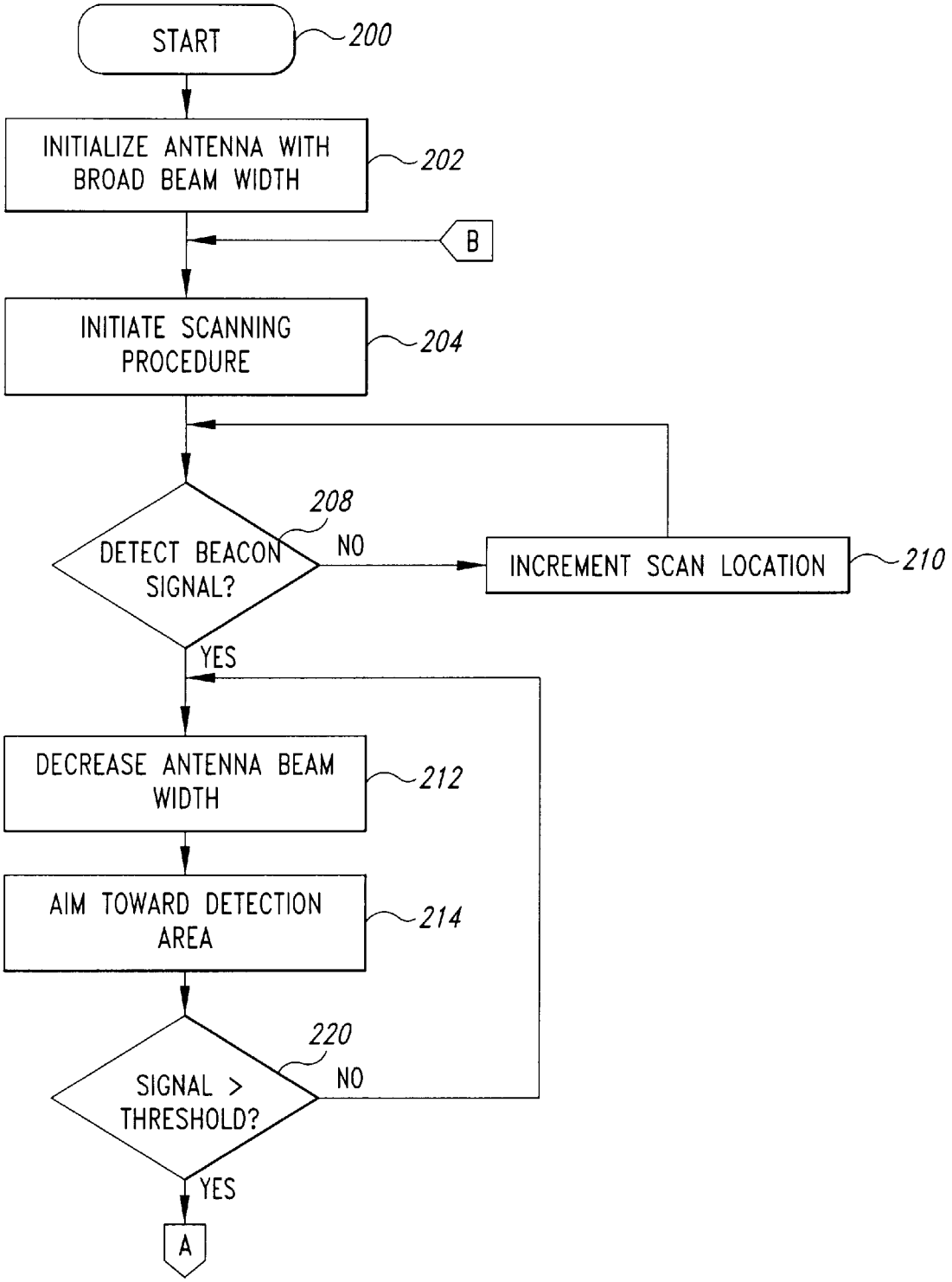
FIGS. 10A and 10B together form a flowchart illustrating the operation of the system of FIG. 3.
Figure 10B:
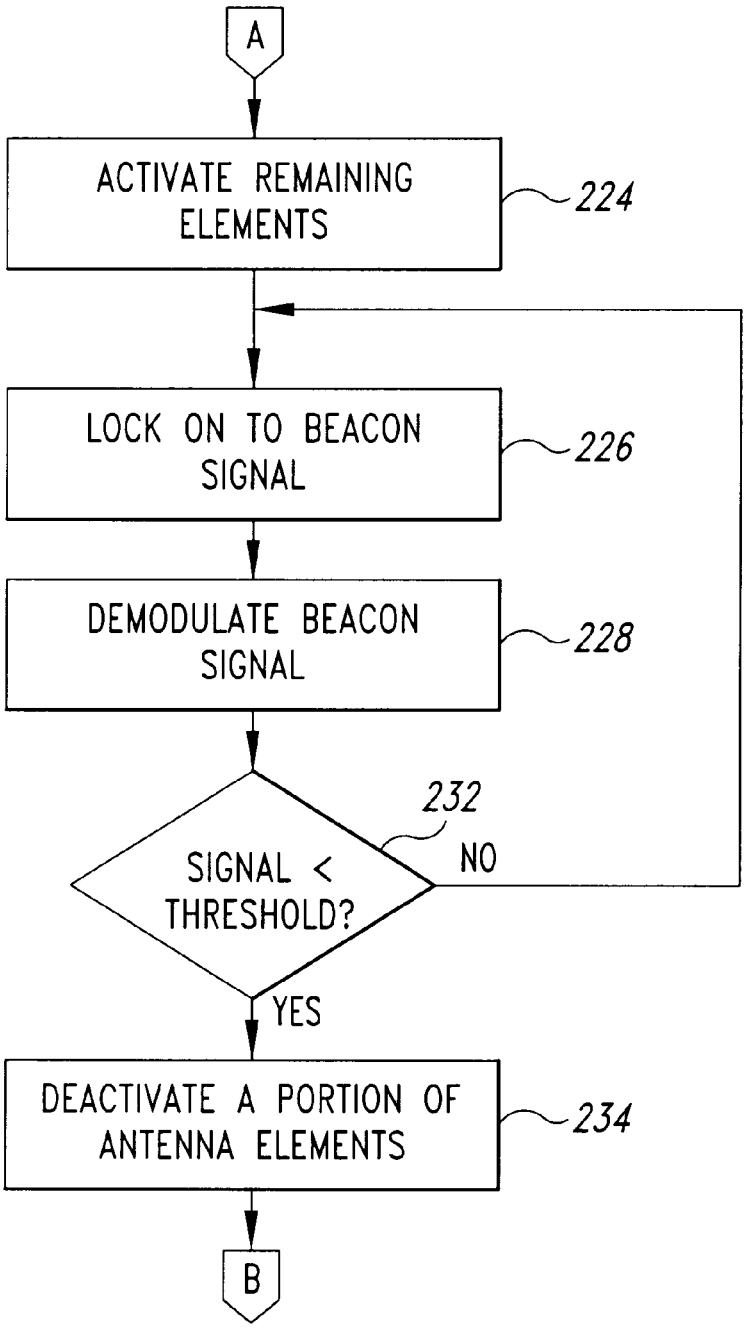

The steps performed by the system 100 are illustrated in the flow chart of FIGS. 10A and 10B. At a start 200, it is assumed that the earth-based station has been powered up and needs to acquire the satellite 4 (see FIG. 1). In step 202, the system 100 initializes the antenna elements 104 such that the antenna 102 has a broad beam width as shown in FIG. 5B. As previously discussed, if the antenna is a phased array antenna, this may be accomplished by activating only a few antenna elements.

In step 204, the system 100 initiates the scanning procedure. It should be noted that, in some cases, the approximate position of the satellite 4 may be known. For example, if the satellite 4 is a geosynchronous satellite, the approximate elevation and azimuth can be determined. Under such circumstances, it is possible to limit the search of the system to a particular segment of the sky. However, if the satellite 4 is in a low-Earth orbit, it may be necessary to scan the entire sky to determine the precise location of the satellite.

In a preferred embodiment, the system 100 sets the phased array antenna 102 to a zenith location directly above the earth-based station and searches in a descending spiral pattern as illustrated in FIG. 5D. This type of search pattern increases the likelihood of detecting the satellite 4 (see FIG. 1) in the shortest period of time. However, alternative scanning procedures can be used by the system 100. For example, the system 100 could start with the lowest elevation used by the phased array antenna and scan for the beacon signal in the azimuth direction by electronically steering the phased array antenna. Accordingly, the present invention is not limited by the specific search pattern used by the system 100.

In decision 208, the system 100 determines whether a beacon signal has been detected. As previously discussed, the initial detection of the beacon signal is performed by the amplitude detector 110 (see FIG. 3) which need not demodulate the beacon signal. If the amplitude detector 110 does not detect the beacon signal, the result of decision 208 is NO. In that event, the system 100 increments the scanned location in step 210 and returns to decision 208 to continue testing for the detection of the beacon signal. The change in the scan location may be performed by electronically steering the phased array antenna 102 or phased array antenna 140 in the elevation and azimuth directions as described above. This process continues until the amplitude detector 110 detects the beacon signal.

When the amplitude detector 110 detects the beacon signal, the antenna controller 112 decreases the antenna beam width in step 212. As previously discussed, the beam Width of the phased array antenna 102 is decreased by activating additional antenna elements 104, as illustrated in FIG. 6A. In step 214, the antenna controller 112 electronically adjusts the active antenna elements so as to aim the phased array antenna 102 toward the area in which the beacon signal was detected. As previously discussed, the antenna controller 112 uses the detection signal 111 to adjust the phase of the active elements 104 so that the phased array antenna 102 is aimed in the appropriate direction. It should be noted that the antenna controller 112 will continue to adjust the phase of the active antenna elements 104 even after the approximate location of the satellite 4 (see FIG. 1) has been determined so that the location of the satellite may be more precisely determined. If the system 100 is utilizing the one-dimensional phased array antenna 140 (see FIGS. 8A and 8B), the antenna controller 112 electronically adjusts the active elements 142 and the elevational angle using the motor 146 to determine the location of the satellite 4 with greater precision.

In decision 220, the amplitude detection system 110 determines whether the beacon signal amplitude is above a predetermined threshold. If the beacon signal threshold is not above the predetermined threshold, the result of decision 220 is NO. In that event, the system 100 activates additional antenna elements and electronically steers the phased array antenna 102 by repeating steps 212 and 214. As previously discussed, additional active elements decrease the beam width of the antenna and also increases the gain provided by the antenna, thus allowing the system 100 to aim the antenna more precisely at the satellite.

If the beacon signal is above the predetermined threshold, the antenna controller 112 activates the remaining antenna elements in step 224 (FIG. 10B). In step 226, the antenna controller 112 electronically steers the antenna elements so as to precisely aim the antenna at the satellite. This completes the acquisition of the satellite 4 (see FIG. 1). In step 228, the system 100 demodulates the received beacon signal in a known manner and generates the data signal 122 (see FIG. 3). Thus, the system 100 initializes the antenna for operation with a broad beam width and incrementally decreases the beam width of the antenna as the location of the satellite 4 (see FIG. 1) is more precisely determined. This process continues until the system is capable of demodulating the beacon signal.

As discussed above, the system 100 can track the beacon signal as the satellite and earth-based station move relative to each other (resulting from mobile earth-based station movement or satellite movement from a non-geostationary satellite). In decision 232 the system 100 monitors the beacon signal amplitude to determine whether it is above or below the predetermined threshold. So long as the beacon signal is above the predetermined threshold, the system 100 maintains lock onto the satellite beacon signal in step 226 and demodulates the beacon signal in step 228.

If the beacon signal falls below the predetermined threshold, in step 234, the antenna controller 112 (see FIG. 3) deactivates a portion of the active antenna elements 104 thus increasing the antenna beam width in an attempt to reacquire the beacon signal from the satellite 4. Following the deactivation of, for example, 20% of the antenna elements in step 234, the system returns to step 204, in FIG. 10A, to reacquire the beacon signal. The reacquisition process is repeated until the beacon signal has been detected and the location of the satellite has been precisely determined.

Although FIGS. 10A and B illustrate the general operation of the system 100, it should be understood that alternative techniques may also be employed. For example, step 234 deactivates a portion of the antenna elements in an effort to reacquire a lost satellite signal. If the location of the satellite is not quickly determined, the antenna controller 112 may continue to deactivate additional antenna elements until the approximate location of the satellite 4 has been detected. Deactivating the antenna elements incrementally increases the beam width of the antenna making it easier to relocate the satellite. When the satellite signal is reacquired, the system incrementally decreases the antenna beam width until the precise location of the satellite has been determined.

From the foregoing it will be appreciated that, although specific embodiments of the invention have been described herein for purposes of illustration, various modifications may be made without deviating from the spirit and scope of the invention. For example, the invention is described for use with a satellite beacon signal. However, it is clear that the principles of the present invention are applicable with any satellite signals. Accordingly, the invention is not limited except as by the appended claims.

What is claimed is:

1. A system for the acquisition of a beacon signal transmitted from a satellite in non-geosynchronous earth orbit, the system comprising:

a phased array antenna having a plurality of antenna elements, with a portion of said plurality of antenna elements being selectively activated and deactivated;

an amplifier coupled to said antenna to amplify signals detected by said antenna and to generate amplified signals;

a signal detection circuit coupled to said amplifier to detect the beacon signal in said amplified signals and generate a strength signal indicative of the signal strength of the beacon signal;

a controller coupled to said antenna to selectively activate and deactivate said portion of said plurality of antenna elements, said controller initially activating less than all of said portion of said plurality of antenna elements and, upon detection of the beacon signal by said signal detection circuit, selectively activating additional ones of said portion of said plurality of antenna elements; and an antenna steering circuit coupled to said antenna elements, said steering circuit adjusting an electrical response of the activated antenna elements based on said strength signal to electrically aim the phased array antenna at the satellite.

2. The system of claim 1 wherein said controller selectively activates additional ones of said portion of said plurality of antenna elements subsequent to detection of said beacon signal if said strength signal indicates the signal strength of the beacon signal is increasing.

3. The system of claim 1 wherein said controller selectively deactivates selected ones of said portion of said plurality of antenna elements subsequent to detection of the beacon signal if said strength signal indicates that the signal strength of the beacon signal is decreasing.

4. The system of claim 1 wherein said phased array antenna is a two dimensional phased array antenna with a first set of said portion of said plurality of antenna elements being arranged in a first dimension and a different second set of said portion of said plurality of antenna elements being arranged in a second dimension substantially orthogonal to said first dimension.

5. The system of claim 1 wherein said phased array antenna is a one dimensional phased array antenna with said plurality of antenna elements being arranged in a first dimension.

6. The system of claim 5, further including a rotating member coupled to said phased array antenna to permit rotational movement of said phased array antenna in a second dimension substantially orthogonal to said first dimension.

7. The system of claim 6 wherein said rotating member includes a motor drive to rotate said phased array antenna in said second dimension.

8. A system for the acquisition of a satellite signal transmitted from a satellite in non-geosynchronous earth orbit, the system comprising:

a phased array antenna having a plurality of antenna elements;

a radio receiver circuit configured to detect and receive the satellite signal; and a controller coupled to said antenna to selectively activate and deactivate at least a portion of said plurality of antenna elements, said controller initially activating less than all of said portion of said plurality of antenna elements and, upon detection of the satellite signal by said radio receiver circuit, selectively activating additional ones of said portion of said plurality of antenna elements.

9. The system of claim 8 wherein said radio receiver circuit includes a signal detection circuit to detect the satellite signal and generate a strength signal indicative of a signal strength of the satellite signal.

10. The system of claim 9 wherein said controller selectively activates less than all of said portion of said plurality of antenna elements upon detection of the satellite signal, and selectively activates additional ones of said portion of said plurality of antenna elements subsequent to detection of the satellite signal if said strength signal indicates that the signal strength of the satellite signal is increasing until all of said portion of said plurality of antenna elements are activated.

11. The system of claim 7 wherein said phased array antenna is configured for operation in the Ka-Band.

12. The system of claim 7 wherein said phased array antenna is a two dimensional phased array antenna with a first set of said portion of said plurality of antenna elements being arranged in a first dimension and a different second set of said portion of said portion of said plurality of antenna elements being arranged in a second dimension substantially orthogonal to said first dimension.

13. The system of claim 7 wherein the satellite signal is a satellite beacon signal and said radio receiver circuit is configured for reception of the satellite beacon signal.

14. The system of claim 8 further including an electronic steering circuit to control the direction of said phased array antenna, said electronic steering circuit tracking the satellite in the non-geostationary earth orbit.

15. A system for the acquisition of a satellite signal transmitted from a satellite in non-geosynchronous earth orbit, the system comprising:

an antenna having an alterable antenna beam width;

a radio receiver circuit configured to detect the satellite signal; and a controller coupled to said antenna to selectively alter said antenna beam width, said controller initializing said antenna for operation with a broad antenna beam width and, upon detection of the satellite signal by said radio receiver circuit, decreasing said antenna beam width.

16. The system of claim 15 wherein said antenna has an incrementally alterable antenna beam width and said controller incrementally and progressively decreases said antenna beam width after detection of the satellite signal by the radio receiver circuit.

17. The system of claim 15 wherein said controller incrementally increases said antenna beam width if, following detection of the satellite signal, the satellite signal is not detected by said radio receiver.

18. The system of claim 15 wherein said radio receiver circuit includes a signal detection circuit to detect the satellite signal and generate a strength signal indicative of a signal strength of the satellite signal, and wherein said controller incrementally decreases said antenna beam width subsequent to detection of the satellite signal by said radio receiver circuit if said strength signal indicates that said signal strength of the satellite signal is increasing.

19. The system of claim 18 wherein said controller incrementally increases said antenna beam width subsequent to detection of the satellite signal by said radio receiver circuit if said strength signal indicates that said signal strength of the satellite signal is decreasing.

20. The system of claim 15 wherein said antenna is directionally adjustable and said controller also controls the direction of the antenna to search for the satellite signal.

21. The system of claim 14 wherein said antenna is configured for operation in the Ka-Band.

22. The system of claim 14 wherein the satellite signal is a satellite beacon signal and said radio receiver circuit is configured for reception of the satellite beacon signal.

23. The system of claim 14 wherein said antenna is a phased array antenna having a plurality of antenna elements that are selectively activatable by said controller to decrease said antenna beam width.

24. The system of claim 14 wherein said antenna is a two dimensional phased array antenna with a first plurality of antenna elements being arranged in a first dimension and a different second plurality of antenna elements being arranged in a second dimension substantially orthogonal to said first dimension, said first and second pluralities of antenna elements being selectively activatable by said controller to incrementally and progressively decrease said antenna beam width after detection of the satellite signal by the radio receiver circuit.

25. The system of claim 14 wherein said antenna is a one dimensional phased array antenna with a plurality of antenna elements being arranged in a first dimension, said antenna elements being selectively activatable by said controller to incrementally decrease said antenna beam width after detection of the satellite signal by the radio receiver circuit.

26. The system of claim 25, further including a rotating member coupled to said phased array antenna to permit rotational movement of said phased array antenna in a second dimension different from said first dimension.

27. A method for the acquisition of a satellite signal transmitted from a satellite in non-geosynchronous earth orbit, the method comprising the steps of:

configuring an antenna having an alterable antenna beam width for operation with a broad antenna beam width;

detecting the satellite signal with said antenna operating with said broad antenna beam width; and upon detection of the satellite signal, incrementally decreasing said antenna beam width.

28. The method of claim 27 wherein said step of detecting the satellite signal includes steering the direction of the antenna to search for the satellite signal.

29. The method of claim 27 wherein said step of detecting the satellite signal includes generating a power signal indicative of a signal strength of the satellite signal and said step of incrementally decreasing said antenna beam width includes continuing to incrementally decrease said antenna beam width if said power signal indicates that said signal strength of the satellite signal is increasing.

30. The method of claim 26 for use with the satellite operating in the Ka-Band, wherein said step of detecting the satellite signal includes detection of Ka-Band signals.

31. The method of claim 26 for use with the satellite signal being a satellite beacon signal, wherein said step of detecting the satellite signal includes reception of the satellite beacon signal.

32. The method of claim 26 wherein said antenna is a phased array antenna having a plurality of antenna elements and said step of decreasing said antenna beam width is performed by selectively activating selected ones of said plurality of antenna elements.

33. The method of claim 26 wherein said antenna is a two dimensional phased array antenna with a first plurality of antenna elements being arranged in a first dimension and a different second plurality of antenna elements being arranged in a second dimension substantially orthogonal to said first dimension, and said step of decreasing said antenna beam width is performed by selectively activating selected ones of said first and second pluralities of antenna elements.

34. The method of claim 33 wherein said step of decreasing said antenna beam width includes incrementally activating selected ones of said first and second pluralities of antenna elements after detection of the satellite signal by said radio receiver circuit.

35. The method of claim 26 wherein said antenna is a one dimensional phased array antenna with a plurality of antenna elements being arranged in a first dimension and said step of decreasing said antenna beam width is performed by selectively activating selected ones of said plurality of antenna elements in said first dimension.

36. The method of claim 35 wherein said step of decreasing said antenna beam width includes incrementally activating selective ones of said plurality of antenna elements in said first direction after detection of the satellite signal by said radio receiver circuit.

37. The method of claim 35 wherein said step of detecting the satellite signal, further includes the step of rotating said phased array antenna in a second dimension different from said first dimension.

* * * * *